US005335805A

United States Patent [19]

Chen

[11] Patent Number: 5,335,805

[45] Date of Patent: Aug. 9, 1994

[54] TRASH CAN STRUCTURE

[76] Inventor: Wen-Kuei Chen, No. 547 Hsi Ta Road, Hsinchu City, Taiwan

[21] Appl. No.: 141,446

[22] Filed: Oct. 22, 1993

[51] Int. Cl.[5] ..... B65D 5/10

[52] U.S. Cl. ..... 220/400; 220/9.1; 220/9.2; 220/908

[58] Field of Search ..... 220/400, 9.1, 9.2, 908, 220/343, 334, 254, 668, 4.28, 403, 404

[56] References Cited

U.S. PATENT DOCUMENTS

| | | | |
|---|---|---|---|
| 608,998 | 8/1898 | Apthorp | 220/9.2 |
| 1,125,100 | 1/1915 | Hoover | 220/9.2 |
| 1,238,993 | 9/1917 | Edwards | 220/908 |
| 3,094,361 | 6/1963 | Poyer | 220/9.2 |
| 3,632,038 | 1/1972 | Souza | 220/908 |
| 4,212,407 | 7/1980 | Lydon | 220/908 |
| 4,989,749 | 2/1991 | Choi | 220/908 |
| 5,048,712 | 9/1991 | Wolters | 220/908 |
| 5,222,704 | 6/1993 | Light | 220/908 |

*Primary Examiner*—Stephen Castellano

*Attorney, Agent, or Firm*—Pro-Techtor International

[57] ABSTRACT

A trash can structure is disclosed including a cubic can body frame on which a gabble-shaped cap frame is releasably mounted. The cap frame includes a gabble-shaped door frame swingably mounted thereon. Each of the body frame, cap frame and door frame has removably attached thereto a cover sheet with desired decorative patterns printed or otherwise formed thereon. The body frame includes a rectangular bottom plate on which four upright bars are releasably mounted with four horizontal bars extending between the upper ends of the upright bars to form the cubic structure. The cap frame and the door frame are constituted by a pair of opposite and spaced triangular side frames connected by three horizontal bar. The door frame is smaller in size than the cap frame and is swingably hung on the upper one of the three horizontal bars of the cap frame so as to cover the access opening formed on the cap member. Joint members are provided at the connections of the bar members to hold the bars together in a releasable manner.

16 Claims, 4 Drawing Sheets

TRASH CAN STRUCTURE

FIELD OF THE INVENTION

The present invention relates generally to a trash can and in particular to a trash can having replaceable decorative cover sheet having patterns printed thereon removably attached to a frame structure thereof.

BACKGROUND OF THE INVENTION

Conventional trash cans are usually molded in a single piece from plastics. In some trash cans, cover members which are also made of plastics are provided. In general, these conventional trash cans are not very beautiful and decorative in outward appearance so that they may not harmonize with the indoor decoration.

Further, the conventional trash can is generally a single piece product which does not allow the user to store or move it in a compact manner.

It is therefore desirable to provide an assembling trash can structure which has an assembling frame on which cover sheet with desired pattern are removably secured so as to allow a user to assemble the trash can by himself and select the pattern of the cover sheet and thus eliminate the above-mentioned problems.

SUMMARY OF THE INVENTION

The principal objective of the present invention is to provide an assembling trash can structure comprising an assembling frame constituted by bar members and joint members with a cover sheet having a desired pattern printed or otherwise formed thereon secured thereto to provide a decorative trash can.

According to an aspect of the present invention, there is provided a trash can structure comprising a cubic can body frame on which a gabble-shaped cap frame is releasably mounted. The cap frame comprises a gabble-shaped door frame swingably mounted thereon. Each of the body frame, cap frame and door frame has removably attached thereto a cover sheet with desired decorative patterns printed or otherwise formed thereon. The body frame comprises a rectangular bottom plate on which four upright bars are releasably mounted with four horizontal bars extending between the upper ends of the upright bars to form the cubic structure. The cap frame and the door frame are constituted by a pair of opposite and spaced triangular side frames connected by three horizontal bar. The door frame is smaller in size than the cap frame and is swingably hung on the upper one of the three horizontal bars of the cap frame so as to cover the access opening formed on the cap member. Joint members are provided at the connections of the bar members to hold the bars together in a releasable manner.

BRIEF DESCRIPTION OF THE DRAWING

The present invention will be better understood from the following description of a preferred embodiment of the present invention, with reference to the attached drawings, wherein.

DETAILED DESCRIPTION OF THE PREFERRED EMBODIMENT

Figure 1:
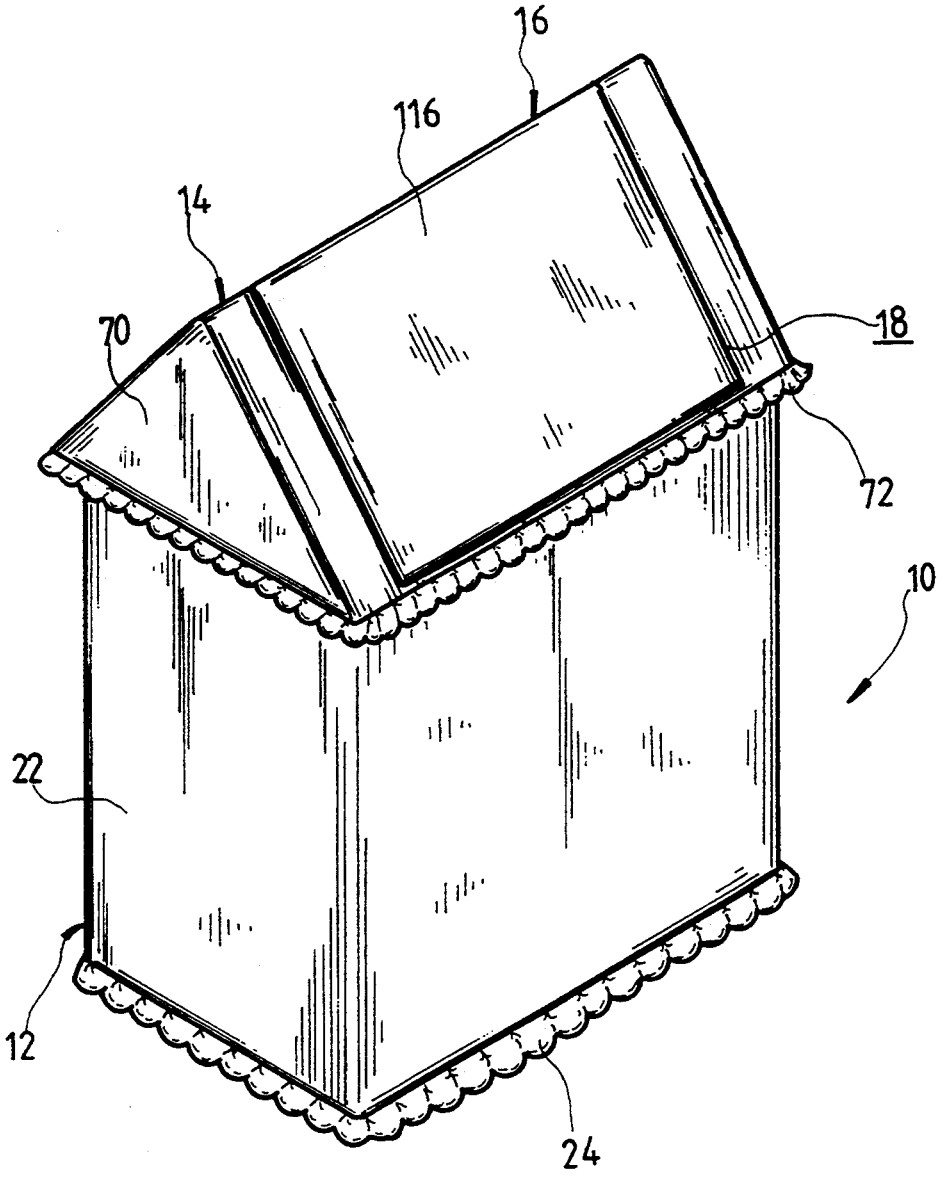
FIG. 1 is a perspective view showing a trash can constructed in accordance with the present invention.

With reference to the drawings and in particular FIG. 1, wherein a trash can constructed in accordance with the present invention, generally designated with the reference numeral 10, is shown, the trash can 10 comprises a can body 12 defining an open interior space on which a cap 14 is mounted. The cap 14 has an access door 16 swingably mounted thereon to cover an access opening 18 for allowing trash to be deposited into a plastic garbage bag (not shown) secured inside the interior space of the can body 12 therethrough.

Figure 2:
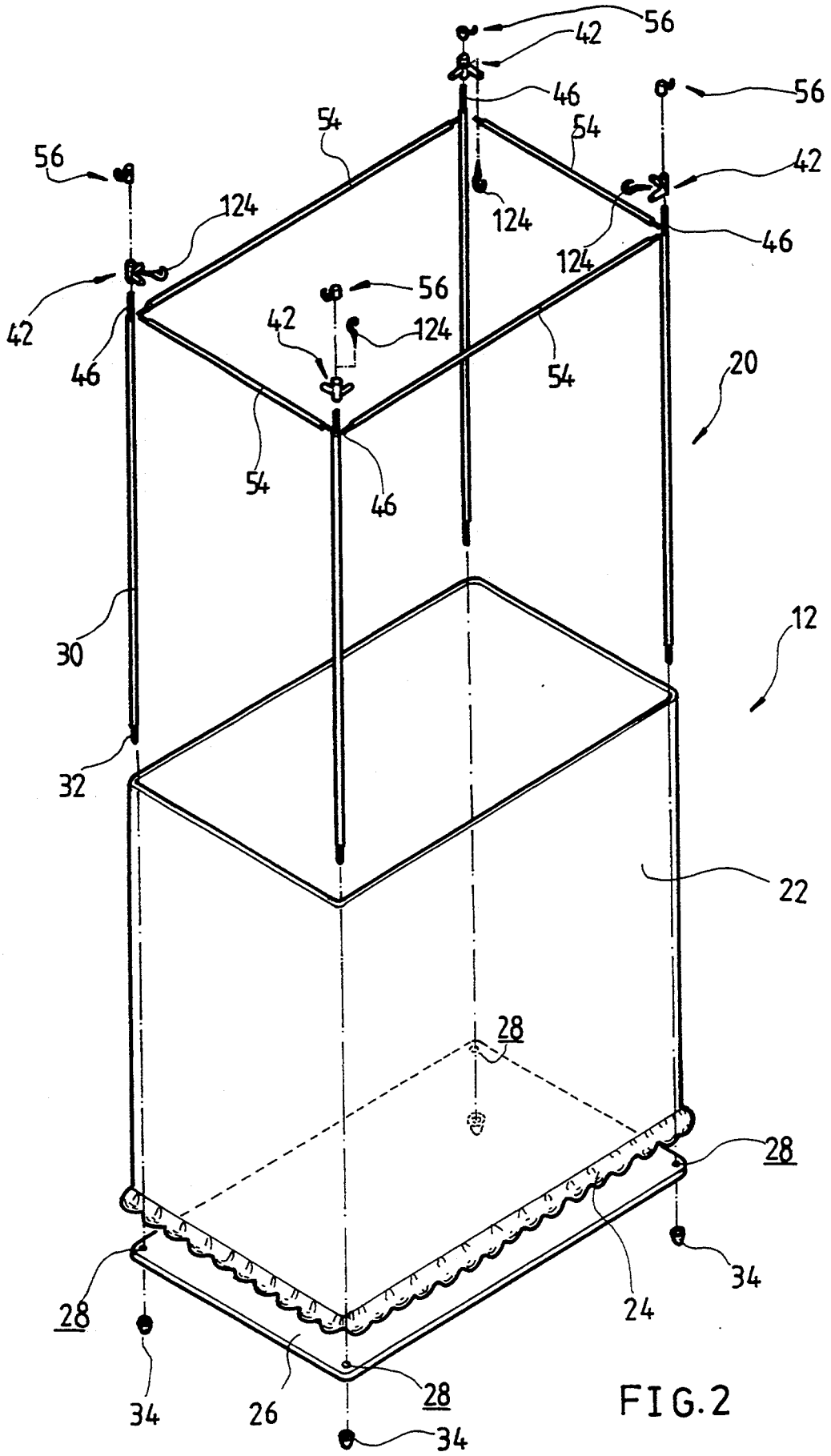
FIG. 2 is an exploded perspective view showing can body of the trash can of the present invention.

The trash can body 12 comprises a frame 20 of which an exploded view is shown in FIG. 2 with a cover sheet 22, preferably having patterns (not shown) printed or otherwise formed thereon, attached thereto. The cover sheet 22 is removably fit on the body frame 20 so that a user may select and use desired patterns that are printed on the cover sheet 22 for decoration purpose. The cover sheet 22 may also comprise a wavy skirt 24 attached to the lower edge thereof for decoration.

With particular reference to FIG. 2, wherein the body frame 20 of the can body 12 is shown, in the embodiment illustrated, the body frame 20 comprises a parallelepiped or cubic structure. It is however understood that configurations other than parallelepiped or cubic shape may also be adapted. The parallelepiped body frame 20 comprises a rectangular bottom plate 26 having four corners each having a hole 28 formed thereon to receive and hold therein the lower end of an elongated upright bar 30. Preferably, the upright bars 30 are made of circular steel or iron rods having a preferred diameter substantially equal to 5.2 mm.

Preferably, the holes 28 are inner-threaded and the lower ends of the bars 30 have a threaded portion 32 to be engageable with the inner-threaded holes 28 for supporting the bars 30 on the bottom plate 26.

The threaded portions 32 of the bars 30 are preferably partially extending through the inner-threaded holes 28 to be engageable by inner-threaded leg member 34 for supporting the can body 12 on ground. The legs 34 are preferably made of a resilient material, such as rubber, for provision of soft contact with ground.

Figure 4:
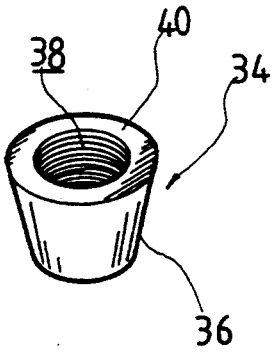
FIG. 4 is a perspective view showing a leg member of the can body shown in FIG. 2.

An embodiment of the leg members 34 is particularly shown in FIG. 4. It is shown that the leg 34 comprises an inverted truncated-conic body 36 having an inner-threaded hole 38 formed on the upper surface 40 thereof to engage the threaded portion 32 of the upright bar 30. It is however understood that legs of other types may also be adapted. For example, casters may be used to replace the resilient legs 34 described herein.

Figure 5:
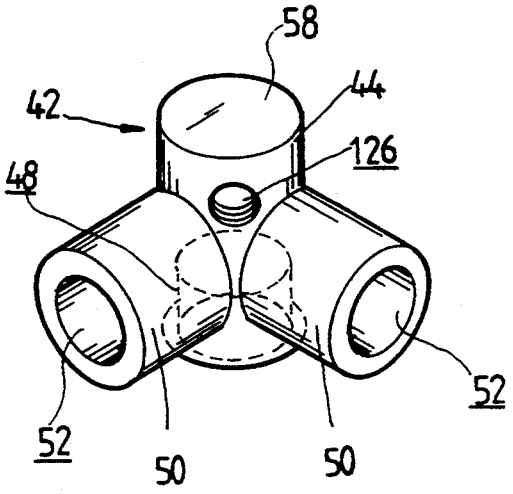
FIG. 5 is a perspective view showing a first joint member of the trash can of the present invention.

On the upper end of each of the upright bars 30, a first joint member 42 is releasably mounted. An enlarged perspective view of the first joint member 42 is shown in FIG. 5. Each of the first joint member 42 comprises an upright cylinder 44 releasably mounted on the upper end of the upright bar 30 in a concentric manner. Preferably, the upper end of the upright bar 30 comprises a shrunk portion 46 (see FIG. 2) to be tightly fit into a hole 48 formed in the upright cylinder 44 of the first joint member 42 and thus frictionally held therein.

Preferably, the first joint member 42 is made of plastics to provide suitable resilience for tightly holding the upper end 46 of the upright bar 30 therein.

The first joint member 42 comprises two side cylinders 50 mounted to the upright cylinder 44 in a mutually-perpendicular manner. Each of the side cylinders 50 has a central hole 52 formed thereon. The first joint members 42 are so mounted on the upper ends 46 of the upright bars 30 that the side cylinders 50 of any two adjacent first joint members 44 are opposite to each other to allow a first horizontal bar 54 extending between the two adjacent first joint members 42 and the opposite ends thereof respectively tightly fit into the holes 52 of the side cylinders 50 and securely held therein so as to maintain the upper ends 46 of the upright bars 30 in position.

Figure 6:
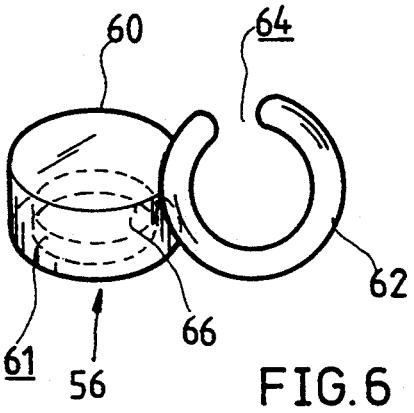
FIG. 6 is a perspective view showing a second joint member of the trash can of the present invention.

A second joint member 56 is mounted on the top end 58 of the upright cylinder 44 of each of the first joint members 42. FIG. 6 shows an enlarged perspective view of the second joint member 56. The second joint member 56 comprises a short cylinder 60 which may have a recess 61 formed thereon to be concentrically tightly fit on the top end 58 of the upright cylinder 44 and thus secured to the upright cylinder 44 of the first joint member 42. The second joint member 56 has a C-shaped hook 62, defining an opening 64 facing upward, formed on the cylindrical side surface 66 of the short cylinder 60.

It is understood that other ways for securing the second joint member 56 to the corresponding first joint member 42 may be adapted, such as by screw extending through both joint members or by threads formed on both members.

The cap 14 of the trash can 10 of the present invention comprises a cap frame 68 preferably having a gabble-shaped structure with triangular cross section on which a cover sheet 70, preferably having patterns (not shown) printed or otherwise formed thereon, removably attached thereon. Similarly to the body cover sheet 22, the cap cover sheet 70 is removable and can be replaced by a different or new one having different patterns printed thereon by the user, if desired, for decoration purpose. The cap cover sheet 70 may also comprise a wavy skirt 72 formed on the lower edge thereof for decoration.

As mentioned previously, the cap cover sheet 70 has an access opening 18 for allowing trash to be deposited into the interior space of the can body 12 therethrough.

Figure 3:
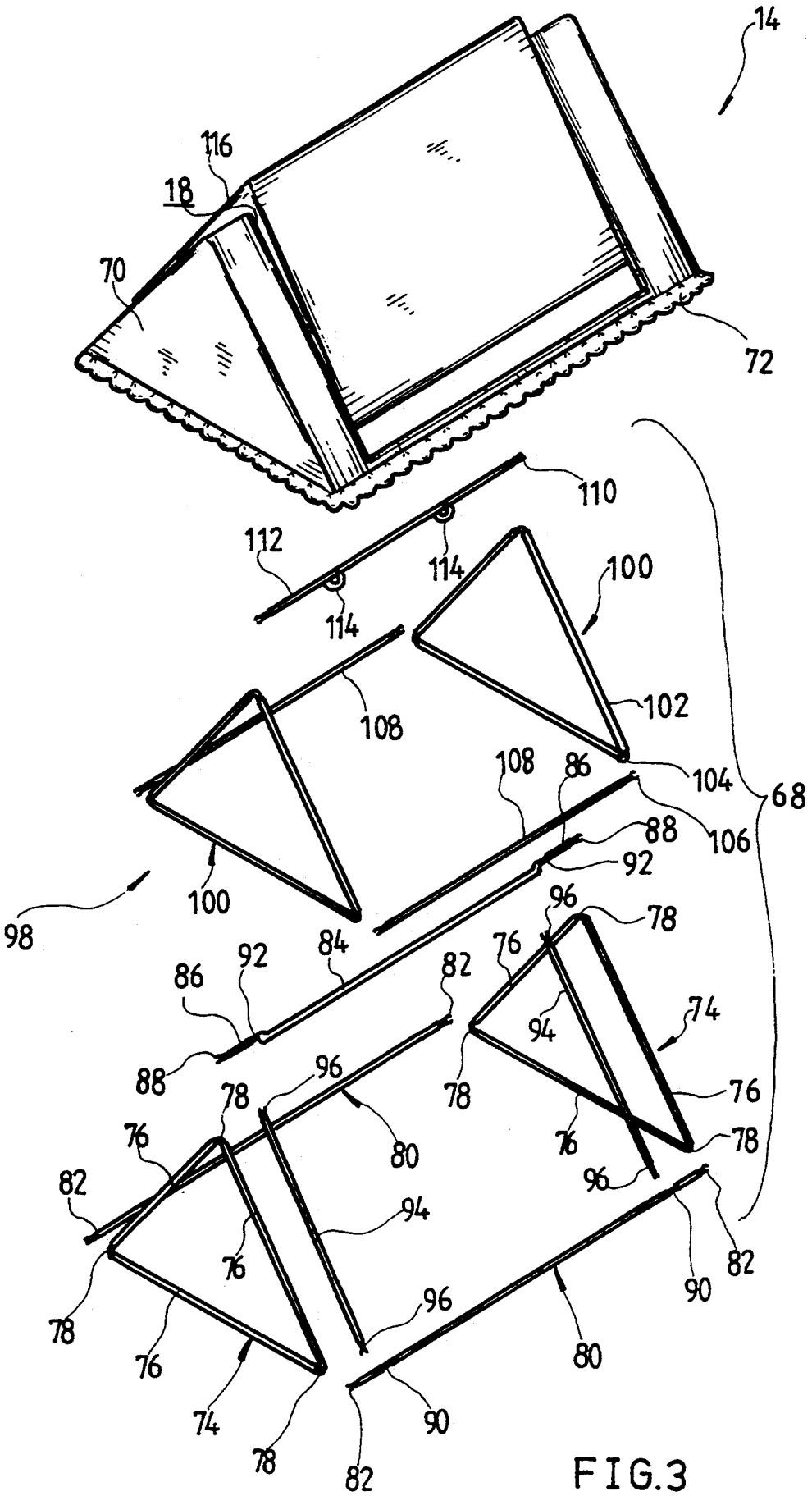
FIG. 3 is an exploded perspective view showing cap member of the trash can of the present invention.

FIG. 3 illustrates an exploded view of the cap 14. The cap frame 68 comprises two opposite and spaced outer triangular side frames 74 having three vertexes, each of which outer triangular side frames 74 is constituted by three bars 76 connected at the vertexes. Each of the outer triangular side frames 74 is supported by two of the second joint members 56 by having the bars 76 thereof releasably received within the C-shaped hooks 62 of the two second joint members 56 via the openings 64 of the C-shaped hooks 62.

Preferably, the outer triangular side frames 68 has a reduced neck 78 formed at each of the vertexes. A second horizontal bar 80 having two split ends 82 is connected between each of two lower vertexes of the outer triangular side frames 68 with the necks 78 of the lower vertexes of the side frames 68 received within the split ends 82 of the second horizontal bar 80. A third horizontal bar 84 having two opposite offset terminal sections 86 formed at the end portions thereof, each having a split end 88 to receive therein the remaining, upper neck 78 of the side frames 74 is also releasably connected between the upper necks of the outer triangular side frames 74.

On at least one of the second horizontal bars 80, two opposite necks 90 are respectively formed in the proximity of the split ends 82 thereof. Corresponding to the necks 90 of the second horizontal bar 80, two opposite necks 92 are formed on the third horizontal bar 84, preferably on the offset terminal sections 86 thereof. An inclined bar 94 having two split ends 96 is disposed between each of the necks 90 of the second horizontal bar 80 and the opposite neck 92 of the third horizontal bar 84 with the necks 90 and 92 respectively received within the split ends 96 thereof for more securely supporting the third horizontal bar 84.

The cap frame 68 also comprises a door frame 98 which in the embodiment illustrated comprises a gabble-shaped structure similar to the cap frame 68 but smaller in size. The door frame 98 comprises two opposite and spaced inner triangular side frames 100 each constituted by three bars 102, shorter than the bars 76 of the outer side frames 74, having necks 104 formed on three vertexes thereof with each of the two lower necks 104 received within split ends 106 of a fourth horizontal bar 108 and the remaining upper neck 104 received in split ends 110 of a fifth horizontal bar 112.

The fifth horizontal bar 112 has a plurality of holed lugs 114, preferably two substantially distant from each other, with the third horizontal bar 84 loosely extending therethrough to allow the door frame 98 to be located between the inclined bars 94 and swingable relative to the cap frame 68.

The access door 16 comprises a cover sheet 116 releasably attached to the door frame 98. Similarly, patterns may be printed or otherwise formed on the door cover sheet 116 for decoration purpose and the cover sheet 116 is removable to be replaced by a different one having different patterns printed thereon.

All the bar members 30, 54, 76, 80, 84, 94, 102, 108, 112 may be formed from the same circular steel rods, having a diameter of approximately 5.2 mm.

Figure 7:
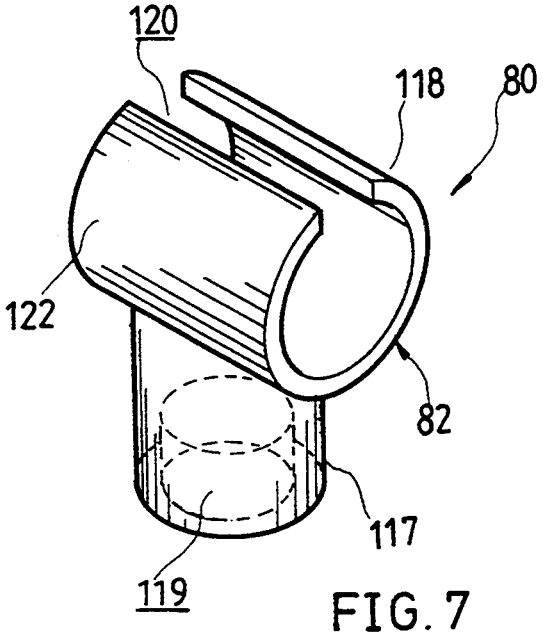
FIG. 7 is a perspective view showing a split end structure of bars constructing the trash can of the present invention.

The split ends 82, 88, 96, 106 and 110 of the bars 80, 84, 94, 108 and 112 may be constructed in the same way as that shown in FIG. 7 wherein an embodiment of the split ends 82, 88, 96, 100 and 110 of the bars 80, 84, 94, 108 and 112 is shown. Taking the second horizontal bar 80 and the split ends 82 thereof as an example, without losing any generality, the split end 82 shown in FIG. 7 comprises an end joint member made of a material of resilience, which end joint member comprises a cylinder member 117 having a hole 119 formed thereon to be tightly fit on an end of the bar 80 and a hollow cylindrical member 118 mounted to the cylinder member 117 in a mutual perpendicular manner. The hollow cylindrical member 118 has a through slot 120 formed on side cylindrical surface 122 thereof. The hollow cylindrical member 118 has an inside diameter which is large enough to receive the necks of the bars therein while the through slot 120 is slightly smaller than the inside diameter of the cylindrical member 118 so that the necks of the bars may be forced to enter the hollow cylindrical member 118 by slightly forcing the through slot 120, which due to the resilience thereof is expandable, to expand to allow the neck to pass.

Figure 8:
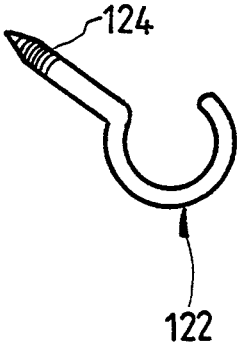
FIG. 8 is a perspective view showing hanger structure for hanging trash bag inside the trash can of the present invention.

A hanger 122 is mounted to each of the first joint member 42 in a manner facing each other. An embodiment of the hanger 122 is particularly shown FIG. 8 which is an enlarged perspective view of the hanger 122. Preferably, the hanger 122 comprises a threaded end 124 to be engageable with an inner threaded hole 126 formed on the first joint member so as to allow the garbage bag (not shown) to be hung inside the trash can 10 in an opened manner for allowing trash to be deposited into the trash can 10 through the access door 16 to fall into the garbage bag.

Figure 9:
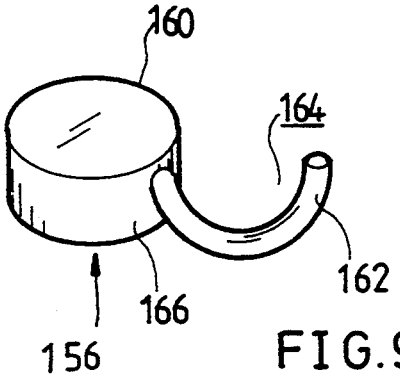
FIG. 9 is a perspective view showing a modification of the second joint member of the present invention illustrated in FIG. 6.

To allow the cap 14 to be opened relative to the can body 12, two of the four second joint members 56 are replaced with modified second joint member 156 which is particularly shown in FIG. 9 wherein similar parts are designated with similar reference numerals but prefixed with "1" for distinction. The modified second joint member 156 has a short cylinder 160 concentrically secured to the upright cylinder 44 of the first joint member 42 with a C-shaped hook 162, defining an opening 164 facing upward, formed on the cylindrical side surface 166 thereof.

The opening 162 of the modified second joint member 156 is, however, wider than the opening 64 of the original second joint member 56, preferably occupying an arc of approximately 180 degrees, so as to allow the outer triangular side frame 74 that is received therein to be easily movable out thereof without any constraint. The smaller opening 64 of the original second joint member 56 helps keeping the outer triangular side frame 74 that is received therein remain inside the C-shaped hook 62 and serving as a rotational axis when the other outer triangular side frame 74 is moved out of the modified second joint member 156 to open the cap 14 relative to the can body 12.

It is apparent that although the invention has been described in connection with the preferred embodiment, it is contemplated that those skilled in the art may make changes to the preferred embodiment without departing from the spirit and scope of the invention as defined in the appended claims.

What is claimed is:

1. A trash can structure comprising:

a can body comprising:

a body frame comprising four elongated upright bars, each having a lower end releasably mounted to a corner of a rectangular bottom plate and an opposite upper end with one of a plurality of first joint members releasably secured thereto, four first horizontal bars being respectively releasably connected between adjacent ones of the first joint members to hold the upright bars in position to form a parallelepiped frame structure which defines an interior space for receiving therein trash;

a first cover sheet having patterns formed thereon removably fit over the parallelepiped body frame;

said first joint members being made of a material of resilience and each comprising an upright cylinder having a hole to be tightly fit on the upper end of each of the upright bars, each of the first joint members comprising two side cylinders mounted to the upright cylinder in a mutually-perpendicular manner, each of the side cylinders having a hole to tightly receive therein an end of one of the first horizontal bars;

a second joint member having a short cylinder releasably mounted to each of said first joint members and a C-shaped hook defining an upward-facing opening mounted to a cylindrical side surface of said short cylinder;

a cap member comprising:

a gabble-shaped frame comprising two outer triangular side frames, each constituted by three bars connected at three vertexes by reduced necks, said gabble-shaped cap frame being releasably supported on said body frame by two of the four second joint members by having the bars received within the C-shaped hooks through the upward-facing openings thereof, a second horizontal bar having two opposite split ends disposed between the two outer triangular side frames with each of two lower ones of the necks of said outer triangular side frames received within the split ends of the second horizontal bar, a third horizontal bar, having two offset terminal sections each having a split end, being disposed between an upper one of the necks of said outer triangular side frames with the upper necks received within the split ends of the third horizontal bar, at least one of the second horizontal bars having two separated necks formed thereon and the third horizontal bar having two opposite necks corresponding to the necks of the at least one of the second horizontal bars formed at the offset terminal sections thereof, an inclined bar having two split ends being connected between each of the necks of the at least one of the second horizontal bars and the corresponding neck of the third horizontal bar; and a second cover sheet having patterns formed thereon removably fit over the gabble-shaped cap frame structure and defining thereon an access opening;

a door member comprising:

a gabble-shaped frame comprising two inner triangular side frames, each constituted by three bars connected at three vertexes by reduced necks which bars being shorter than the bars constituting the outer triangular side frames, a fourth horizontal bar shorter than the second horizontal bar and having two opposite split ends disposed between the two inner triangular side frames with each of two lower ones of the necks of said inner side frames received within the split ends of the fourth horizontal bar, a fifth horizontal bar, shorter than the third horizontal bar and having two opposite split ends, being disposed between an upper one of the necks of said inner side frames with the upper necks received within the split ends of the fifth horizontal bar, a plurality of holed lugs secured to the fifth horizontal bar with the third horizontal bar extending therethrough to have said door frame located between the inclined bars of said cap frame and swingable relative to said cap frame; and a third cover sheet having patterns formed thereon removably fit over the door frame structure; and a garbage bag hanger releasably mounted to each of the first joint members in such a way to face each other so as to allow a garbage bag to be hung inside the can body.

2. A trash can as claimed in claim 1, wherein the upright bars and first horizontal bars of said body frame, the bars constituting the outer triangular side frames, the second horizontal bars and the third horizontal bar of said cap frame and the bars constituting the inner triangular side frames, the fourth horizontal bars and the fifth horizontal bar of said door frame are made of round rods of a suitable diameter.

3. A trash can as claimed in claim 2, wherein the suitable diameter comprises 5.2 mm.

4. A trash can as claimed in claim 2, wherein the round rods comprise steel rods.

5. A trash can as claimed in claim 1, wherein the lower end of each of the upright bars has a threaded portion to be engageable with an inner-threaded hole formed at each corner of the bottom plate of said body frame.

6. A trash can as claimed in claim 5, wherein the threaded portion of each of the upright bars is partially extending out of the inner-threaded hole of the bottom plate to allow an inner-threaded leg member to threadingly engage therewith.

7. A trash can as claimed in claim 6, wherein the leg is made of rubber.

8. A trash can as claimed in claim 1, wherein the first joint members are made of plastics.

9. A trash can as claimed in claim 1, wherein the second joint members are made of plastics.

10. A trash can as claimed in claim 9, wherein each of the second joint members comprises a recess to be tightly fit on the upright cylinder of the first joint member by slightly expanding the recess.

11. A trash can as claimed in claim 1, wherein each of the split ends of the second, third, fourth and fifth horizontal bars and the inclined bars comprises an end joint member made of a material of resilience, which end joint member comprises a first cylinder having a hole formed thereon to be fit on an end of each of said horizontal bars and inclined bars and a hollow cylindrical member mounted to the first cylinder in a mutually-perpendicular manner, said hollow cylindrical member having a through slot to allow the neck to be received therein to pass by expanding the through slot.

12. A trash can as claimed in claim 11, wherein the end joint members are made of plastics.

13. A trash can as claimed in claim 1, wherein the body cover sheet comprises a wavy skirt formed on a lower edge thereof.

14. A trash can as claimed in claim 1, wherein the cap cover sheet comprises a wavy skirt formed on a lower edge thereof.

15. A trash can as claimed in claim 1, wherein the C-shaped hooks of two of said second joint members which receive the same outer triangular side frame therein have an upward-facing opening wider than that of the other two second joint members to allow the outer triangular side frame received therein to be movable out thereof without any constraint.

16. A trash can as claimed in claim 1, wherein the garbage bag hanger comprises a threaded end engageable with an inner-threaded hole formed on the upright cylinder of each of the first joint members.

* * * * *